US007837444B2

(12) United States Patent
Conrad

(10) Patent No.: US 7,837,444 B2
(45) Date of Patent: Nov. 23, 2010

(54) VANE ARRANGEMENT AND A METHOD OF MAKING VANE ARRANGEMENT

(75) Inventor: Rodney D. Conrad, Zionsville, IN (US)

(73) Assignee: Rolls-Royce PLC, London (GB)

( * ) Notice: Subject to any disclaimer, the term of this patent is extended or adjusted under 35 U.S.C. 154(b) by 811 days.

(21) Appl. No.: 11/600,146

(22) Filed: Nov. 16, 2006

(65) Prior Publication Data

US 2007/0140854 A1 Jun. 21, 2007

(30) Foreign Application Priority Data

Dec. 15, 2005 (GB) ..... 0525469.3

(51) Int. Cl.
*F04D 29/34* (2006.01)

(52) U.S. Cl. ..... 416/213 R; 416/214 R; 228/118

(58) Field of Classification Search ..... 416/193 A, 416/213 R, 214 R, 214 A; 29/45.8, 525.14, 29/462; 228/118, 212, 213, 245–262
See application file for complete search history.

(56) References Cited

U.S. PATENT DOCUMENTS 3,778,184 A * 12/1973 Wood ..... 415/209.4
4,139,329 A 2/1979 Korta
5,074,752 A * 12/1991 Murphy et al. ..... 415/209.4
5,634,768 A 6/1997 Shaffer et al.
5,732,468 A * 3/1998 Galley et al. ..... 29/889.1
6,163,959 A 12/2000 Arratiz et al.

FOREIGN PATENT DOCUMENTS

| | | |
|---|---|---|
| EP | 1 120 480 A3 | 11/2001 |
| GB | 727608 | 4/1955 |
| GB | 1437510 | 5/1976 |

* cited by examiner

*Primary Examiner*—Edward Look
*Assistant Examiner*—Dwayne J White
(74) *Attorney, Agent, or Firm*—Oliff & Berridge, PLC

(57) ABSTRACT

Within gas turbine engines 10 it is necessary to provide fixed vanes which comprise an aerofoil in the gas flow through the gas turbine engine 10. These vanes are subject to significant stressing. Therefore it is generally necessary to secure the vane at one end 103 through an appropriate bond such as brazing while at another end a friction damping response is achieved. By providing an anti-bonding layer it is possible to prevent a mechanical bond being formed at the friction damping end 105. Furthermore, a tight fit can be emphasized by residual bonding material remaining after an attempted bonding process upon the anti-bonding layer.

16 Claims, 2 Drawing Sheets

VANE ARRANGEMENT AND A METHOD OF MAKING VANE ARRANGEMENT

BACKGROUND

The present invention relates to vane arrangements used in gas turbine engines.

SUMMARY

Referring to FIG. 1, a gas turbine engine is generally indicated at 10 and comprises, in axial flow series, an air intake 11, a propulsive fan 12, an intermediate pressure compressor 13, a high pressure compressor 14, a combustor 15, a turbine arrangement comprising a high pressure turbine 16, an intermediate pressure turbine 17 and a low pressure turbine 18, and an exhaust nozzle 19.

The gas turbine engine 10 operates in a conventional manner so that air entering the intake 11 is accelerated by the fan 12 which produce two air flows: a first air flow into the intermediate pressure compressor 13 and a second air flow which provides propulsive thrust. The intermediate pressure compressor compresses the air flow directed into it before delivering that air to the high pressure compressor 14 where further compression takes place.

The compressed air exhausted from the high pressure compressor 14 is directed into the combustor 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbines 16, 17 and 18 respectively drive the high and intermediate pressure compressors 14 and 13 and the fan 12 by suitable interconnecting shafts 26, 28, 30

FIG. 1 illustrates a three shaft engine but it will be understood that vane arrangement are also used in two shaft and single shaft engines.

It will be understood in order to achieve operational efficiency air flows through the gas turbine engine will generally be regulated by guide vanes 31 between compressor stages and turbine stages. These vanes are generally fixed arrangements and are formed into an assembly about the circumference of the engine 10.

Previously it has been known to provide vane arrangements in which individual aerofoils are bonded by such processes as brazing at one end to a platform, and hot upset presentation at the other end of the aerofoil vane to another platform, such as a concentric annulus. The hot upset ensures a tight fit between the aerofoil and the platform but allows small relative movements between the aerofoil and the platform. These movements facilitate friction damping which in turn reduces the dynamic stressing and vibration on the aerofoil in operation. It is known that if both ends of the aerofoil are bonded through a rigid fixing such as brazing then the level of dynamic stressing increases and so the prospects for in service failure.

Unfortunately, hot upsetting as an operation becomes increasingly more difficult when the angle between the aerofoil and platform varies significantly from a perpendicular presentation. Use of more complex three dimensional aerofoil shapes results in a significant amount of end bending making use of a simple hot upsetting procedure whilst still achieving adequate operational results more difficult. Hot upsetting makes utilisation of desired complex three dimensional aerofoil shapes for engagement with inner and outer platforms whilst achieving adequate friction damping for operational purposes at least problematic.

In accordance with the present invention there is provided a vane arrangement for a gas turbine engine, the arrangement comprises a vane confined at an end by a platform with an anti bonding layer between the end of the vane and the platform to prevent a bond forming between them.

Typically, the vane is secured by a bond at a bond end of the vane to a further platform. Normally the bond is a braze between the bond end of the vane and the further platform.

Typically the anti bonding layer is an anti brazing compound.

Possibly, the anti bonding layer is applied to the end of the vane. Alternatively, or additionally the anti bonding layer is applied to the platform against which the vane is confined.

Typically, the end is located in a slot or aperture in the platform.

Potentially, the vane is further confined by residual bonding compound upon the anti bonding layer remaining between the end and the platform.

Generally, the end and the platform form a friction damping combination. Possibly, a friction fit combination.

Generally, also in accordance with the present invention there is provided a vane assembly comprising a plurality of vane arrangements as described above.

Also in accordance with the present invention, there is provided a method of forming a vane arrangement for a gas turbine engine, the method comprising:— a) Presenting an end of a vane to a platform with an anti bonding layer between them; and, b) retaining the end in a confined association with the platform whilst the anti bonding layer prevents a bond forming between the end and the platform.

Generally, retaining of the end is achieved by bonding the other end of the vane to a further platform with the vane confined between the platform and the further platform. Normally, the bonding is by a brazing process.

Possibly, the anti bonding layer is applied to the end of the vane. Alternatively or additionally the anti bonding layer is applied to the platform.

Possibly, a slot is formed in the platform to receive the end.

Potentially, the vane is further confined by residual bonding compound remaining after attempting to bond a bonding compound with the anti bonding layer.

An embodiment of the present invention will now be described by way of example and with reference to the accompanying drawing in which FIG. 2. illustrates a schematic side view of a vane arrangement.

Modern gas turbine engines increasingly rely upon "3D" aerofoil vane shapes that contain significant "end bend" near the inner and outer platforms which retain and confine these vanes. The complex shapes make it difficult to utilise previous hot upset processes to manufacture vane assemblies. In fact, many of today's vane aerofoils have shapes that cannot be hot upset using current methods. By using an anti-brazing compound on one end applied to either the aerofoil end or adjoining platform surfaces, the residual braze after attempted brazing will fill in the gap between the two components providing intimate contact and damping. However, the anti-braze compound will prohibit the two components from bonding together and becoming rigidly fixed. This braze operation could be performed simultaneously with the braze operation used to secure the other bond end of the vane to a platform such as a mounting annulus platform.

As indicated above brazing is one of the principal manners of bonding a vane in a vane arrangement between platforms to define a vane assembly comprising a number of such arrangements in the flow path of a gas turbine engine. It will be understood that brazing is preferred in that it allows a number of brazing joints and bonds to be formed simultaneously. In such circumstances with the present invention as described, the brazing bond at the bond end of the vane can be formed at the same time as a restrained end of the vane is constrained in association with another platform. Such an approach as indicated allows a number of vanes to be incorporated in accordance with the present arrangements to form a vane assembly for a gas turbine engine in one processing stage and so improves manufacturing efficiency.

As indicated above current complex 3D aerofoils with large amounts of end bend make it difficult or impossible to use existing hot upset techniques. Hot upsetting provides a close fit but allows the small relative movements required for friction damping. Conventional brazing of both aerofoil ends would secure the aerofoil but would not provide damping. Thus, aerofoil fatigue cycle stresses could significantly increase and cause a premature failure. Attempted brazing of one end covered with anti-braze compound achieves a tight fit but doesn't mechanically bond the components so damping is retained. The residual brazing compound remaining on the anti-braze compound ensuring a tight fit for friction damping.

BRIEF DESCRIPTION OF THE DRAWINGS

The invention will be described with reference to the following drawings, wherein.

DETAILED DESCRIPTION OF EMBODIMENTS

Figure 1:
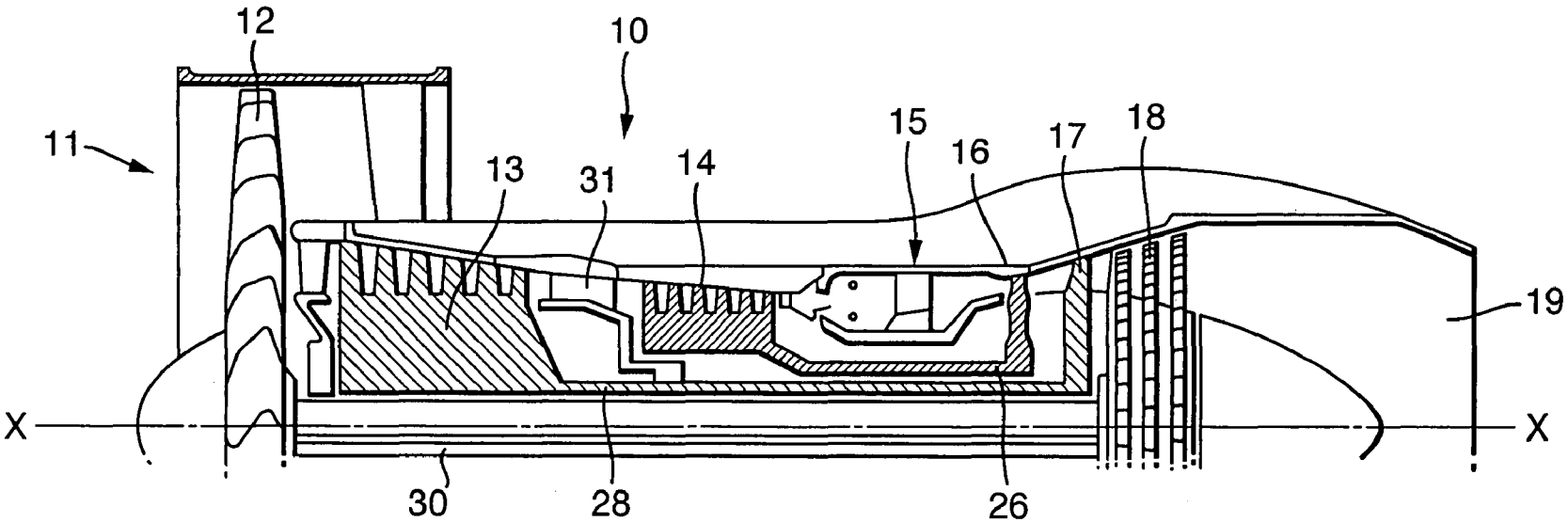
FIG. 1 illustrates a three shaft engine.
Figure 2:
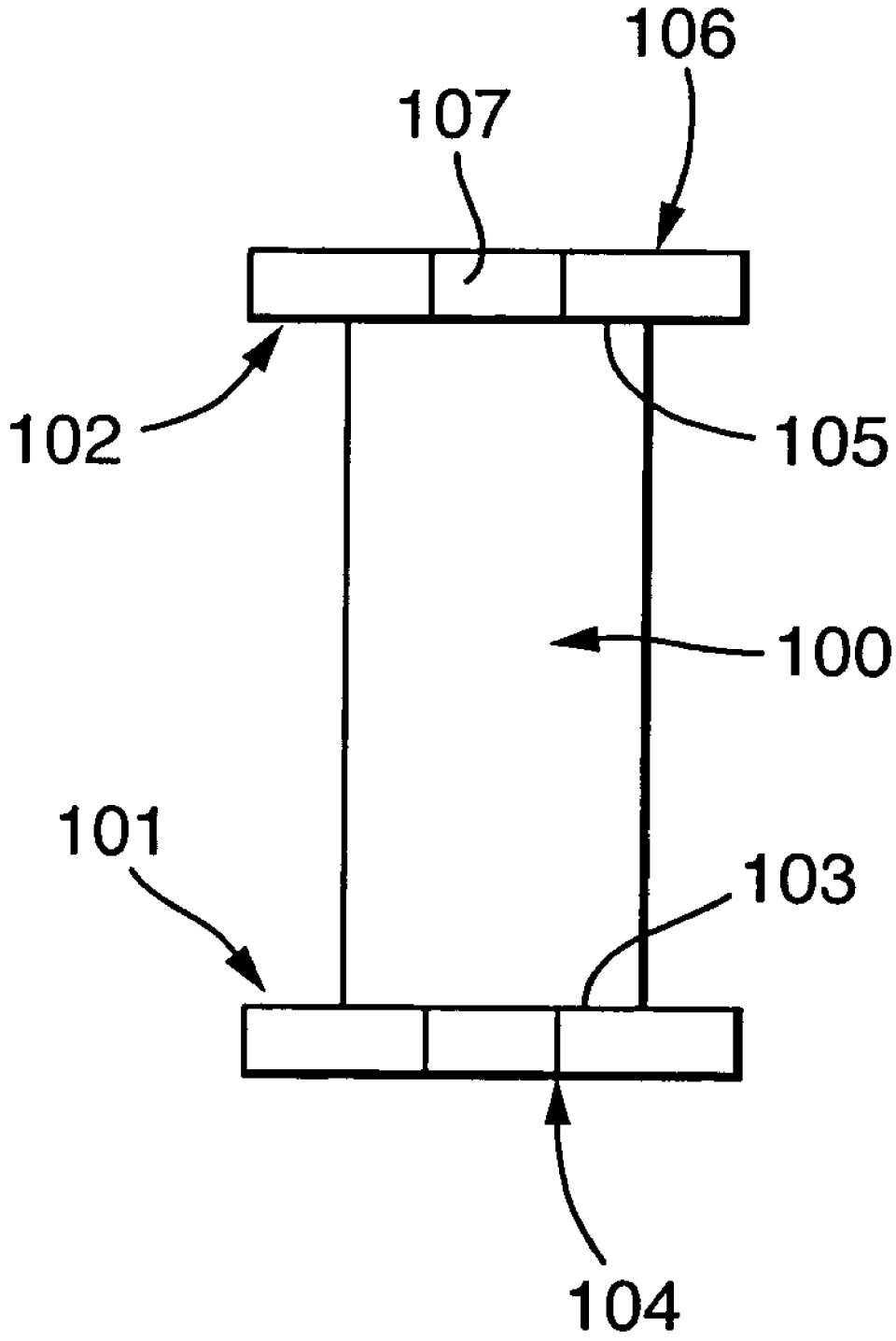
FIG. 2 illustrates a schematic illustration of a vane arrangement in accordance with the invention.

In FIG. 2, a vane 100 is located between platforms 101, 102. The vane 100 generally takes the form of an aerofoil and as indicated in a gas turbine engine acts in the flow path through the engine to adjust and normally straighten gas fluid flows for better operational efficiency. In such circumstances the vane 100 arrangement should be able to accommodate the necessary stress and vibrations which may cause premature failure. In the embodiment depicted in FIG. 2 a bonding platform 101 is provided at a bonding end 103 of the vane 100 with the aerofoil secured with a conventional braze bond 104. In such circumstances the vane 100 is appropriately presented to the platform 101 which in turn is accurately secured within the gas turbine engine so ensuing appropriate presentation of the vane in its arrangement as part of a vane assembly within the engine.

In accordance with the present arrangement an end 105 of the vane 100 is confined by a further platform 102. A layer of anti bonding material or compound is placed between the end 105 and the platform 102 so that no bond is created during a bonding process, that it is to say brazing. In such circumstances a confined association 106 is provided between the platform 102 and the end 105. The anti bonding layer may be applied to the end 105 or the platform 102 or both provided no bond is formed between the end 105 and the platform 102.

Possibly, the end 105 will be accepted within a recess or slot 107 in the platform 106 to further facilitate confinement of the vane 100 whilst avoiding a mechanical bond between the components. In such circumstances as indicated above there will be friction damping combination between the vane 100 and in particular the end 105 and the platform 102.

It will be understood that the platforms 101, 102 in accordance with the present arrangement will generally be the inner and outer platforms which comprise the inner annulus and outer annulus of a gas turbine engine. In such circumstances the platforms will be subject to thermal cycling and as indicated above may create stresses which can be relieved through a friction damping combination of the end 105 confined by the platform 102. Although it is depicted in FIG. 2 that the fixed bonding braze 103 is on the inner side platform with the confined but not mechanically secured end 10S combining with the outer platform 104 but it will be understood that the situation could be vice versa where appropriate.

It will be appreciated that although not mechanically bonded it is still important that there is a tight fit to achieve an appropriate level of friction damping. In such circumstances generally the association between the end 105 and the platform 102 will be packed with residual bonding compound which remains after attempting to bond at this position to the anti bonding layer. It will be appreciated that the brazing process involves fusing normally a compound such as copper, nickel or silver braze between two surfaces in order to create the brazing bond. By application of an anti bonding/anti brazing layer it will be understood that this fusing process is prevented or inhibited and a mechanical bond between the end 10S and the platform 106 is prevented. However, the brazing compound to be used for fusing between the surfaces of the end 105 and the platform 106 will remain after a failed brazing bonding process and will generally lie upon the anti bonding layer to fill any gap. It may be that molten brazing compound may be drawn by capillary action into that gap. In such circumstances upon cooling there is no mechanical bond but a close packing fit between the components, that it is to say the end 105 engaging the platform 102 which allows movement between the surfaces against friction resistance which as indicated creates a vibration damaging effect. In such circumstances it can be argued there is an interference or close tolerance fit between the opposed parts of the vane and the platform to form the friction damping combination.

As indicated above the present vane arrangement is generally utilised in a vane assembly in which a large number of such vane arrangements are located circumferentially about inner and outer platforms forming the gas turbine engine. The number and distribution of such vane arrangements and therefore the aerofoils which form the vane arrangements will be dependent upon particular operational requirements within the gas turbine engine. The present vane arrangement allows a wider range of three dimensional aerofoil shapes to be used in comparison with previous vane arrangements and methods of making vane arrangements including hot upsetting of the vane against its platform.

It will be appreciated that the anti bonding or anti-brazing layer may be applied in any appropriate manner. Thus, the anti bonding layer may be applied by spraying, painting or dipping the respective parts of the vane and/or platform. Normally, the anti bonding layer will be applied to one side of the junction between the vane and the platform for simplicity and also to ensure that there is no potential contamination of the parts of the vane arrangement at which it is desired for bonding to occur.

It will be appreciated that each individual vane arrangement and its aerofoil in the vane assembly will generally require accurate presentation within the assembly. Thus, the aerofoils which form the vanes will be reasonably accurately presented in the platforms and this presentation retained by the fixed bonding at one end and the combination of the anti bonding layer and the residual bonding material remaining after failed bonding at the abutment of the other end with its platform.

Although not conventional it is possible that an aerofoil in accordance with the present invention may be secured at both ends by an appropriate interference fit created by presentation of the ends to respective platforms, coating these platforms with an anti bonding layer and then effectively packing the association between the ends of the aerofoil vane and the platform with residual bonding compound remaining after failed bonding due to the anti bonding layer between them. It will be understood that a tight fit will therefore be created which will result in appropriate retention and presentation of the aerofoil vane particularly if at least one end of the vane is secured in a slot formed in its platform.

The present arrangement allows an existing brazing operation with regard to the fixed bond securing one end of vane aerofoil to be utilised at the same time as the means for provision of a friction damping combination through confinement of the other end of the vane with a platform. The anti bonding layer preventing formation of a mechanical bond whilst achieving a tight fit for the appropriate friction damping response by the combination. By appropriate choice of the brazing, or other bonding, material it will be appreciated that variations in the friction damping response can be achieved dependent upon the choice of brazing compound which remains after the failed brazing operation to form a bond in view of the anti brazing layer.

I claim:

1. A vane arrangement for a gas turbine engine, the arrangement comprises a vane confined at an end by a platform with an anti bonding layer between the end of the vane and the platform to prevent a bond forming between them, wherein the anti bonding layer is an anti brazing compound.

2. The arrangement as claimed in claim 1 wherein the vane is secured by a bond at a bond end of the vane to a further platform.

3. The arrangement as claimed in claim 2 wherein the bond is a braze between the bond end of the vane and the further platform.

4. The arrangement as claimed in claim 1 wherein the end is located in a slot or aperture in the platform.

5. The arrangement as claimed in claim 1 wherein the anti bonding layer is applied to the platform against which the vane is confined.

6. The arrangement as claimed in claim 1 wherein the vane is further confined by a residual bonding compound upon the anti bonding layer between the end and the platform.

7. The arrangement as claimed in claim 1 wherein the end and the platform form a friction damping combination.

8. A method of forming a vane arrangement for a gas turbine engine, the method comprising:

a) presenting an end of a vane to a platform with an anti bonding layer between them; and b) retaining the end in a confined association with the platform whilst the anti bonding layer prevents a bond forming between the end and the platform, wherein the anti bonding layer is an anti brazing compound.

9. The method as claimed in claim 8 wherein retaining of the end is achieved by bonding the other end of the vane to a further platform with the vane confined between the platform and the further platform.

10. The method as claimed in claim 9 wherein the bonding is by a brazing process.

11. The method as claimed in claim 8 wherein the anti bonding layer is applied to the end of the vane.

12. The method as claimed in claim 8 wherein the anti bonding layer is applied to the platform.

13. The method as claimed in claim 8 wherein a slot is formed in the platform to receive the end.

14. The method as claimed in claim 8 wherein the vane is further confined by a residual bonding compound remaining after attempting to bond a bonding compound with the anti bonding layer.

15. A vane assembly comprising a plurality of vane arrangements as claimed in claim 1.

16. A gas turbine engine incorporating a vane assembly as claimed in claim 15.

* * * * *